US006303933B1

(12) United States Patent
Dickhoff

(10) Patent No.: US 6,303,933 B1
(45) Date of Patent: Oct. 16, 2001

(54) APPARATUS AND METHOD OF ATTACHING CORONA WIRE TO CORONA CHARGER HOUSING

(75) Inventor: Andreas Dickhoff, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/280,121

(22) Filed: Mar. 26, 1999

(51) Int. Cl.[7] ..... H01J 9/18
(52) U.S. Cl. ..... 250/324; 250/325; 250/326
(58) Field of Search ..... 250/324–326

(56) References Cited

U.S. PATENT DOCUMENTS 3,790,999 * 2/1974 Gallo, Jr. .
3,943,418 * 3/1976 Quang .
4,110,614 * 8/1978 Sarid et al. .
4,110,811 * 8/1978 Hubble, III et al. .
4,118,751 * 10/1978 Hubble, III et al. .
4,320,957 * 3/1982 Brown et al. .
4,549,244 * 10/1985 Driessen .
4,764,675 * 8/1988 Levy et al. .
5,672,871 * 9/1997 Jacobs et al. .
6,144,826 * 11/2000 Mitchell et al. .

* cited by examiner

*Primary Examiner*—Teresa M. Arroyo
*Assistant Examiner*—Sharon Payne

(57) ABSTRACT

An apparatus comprising: (i) a corona charger housing including at least two cavities; (ii) a corona wire strung across the housing, the corona wire having at least one end located in one of the cavities; and (iii) a pin at least partially located inside one of the cavities, the pin fixedly securing the end of corona wire inside the cavity. A preferred embodiment of the present invention includes (i) a corona charger housing including at least two cavities; (ii) a corona wire having two ends, the corona wire being strung across the housing, the corona wire having each of its ends located in one of the cavities; (iii) pins at least partially located inside the cavities. The pins fixedly secure the ends of corona wire inside the cavities.

20 Claims, 5 Drawing Sheets

APPARATUS AND METHOD OF ATTACHING CORONA WIRE TO CORONA CHARGER HOUSING

CROSS REFERENCE TO RELATED APPLICATIONS

Reference is made to commonly assigned, copending U.S. patent application Ser. No. 09/280,119 , entitled A METHOD OF MOUNTING CORONA WIRE INTO A CHARGER HOUSING OF AN ELECTROPHOTOGRAPHIC APPARATUS AND AN APPARATUS FOR MOUNTING CORONA WIRES, by Andreas Dickhoff; U.S. patent application Ser. No. 09/277,430, entitled A CORONA CHARGER WITH A SERPENTINE STRUNG CORONA WIRE, by Andreas Dickhoff; and U.S. patent application Ser No. 09/277,618, now U.S. Pat. No. 6,108,504, entitled CORONA WIRE REPLENISHING MECHANISM, by Andreas Dickhoff, filed concurrently herewith.

FIELD OF THE INVENTION

The invention is in the field of electrophotography. More specifically, it relates to an apparatus and a method for attaching corona wire ends to the housing of a corona charger.

BACKGROUND OF THE INVENTION

A corona charger is used to generate an electrostatic charge on a surface, for example, a sheet of paper, a photoconductor or a transport web. A corona charger typically includes one or more tightly strung corona wires. The two ends of each wire are firmly attached to the charger housing, for example, by copper lugs, or by manually twisted loops which are connected to the charger housing. Applying high voltage to these corona wires creates the requisite electrostatic charge. Such corona chargers are disclosed, for example, in U.S. Pat. Nos. 4,112,298; 5,140,367; 5,181,069; and 5,424,540. Having loose wire ends creates an unwanted corona which is undesirable.

U.S. Pat. No. 5,358,165 discloses a wiring machine of corona discharge device. This wiring machine is very complex, very bulky and includes a welding machine for welding an arranged wire onto the corona discharge device.

SUMMARY OF THE INVENTION

It is an object of the present invention to provide an improved apparatus and method for attaching a corona wire to a corona charge housing.

According to one aspect of the present invention, an apparatus includes: (i) a housing of a corona charger that has at least one cavity; (ii) a corona wire strung across the housing, the corona wire has at least one end located in this cavity; and (iii) a plug fixedly securing the wire end inside the cavity.

According to another aspect of the present invention a method of securing a corona charge wire to corona housing comprises the steps of: (i) stringing a corona wire across a cavity; (ii) cutting the corona wire, thereby forming an end of the corona wire; (iii) securing the end of the corona wire inside the cavity It is an advantage of the present invention that it eliminates unwanted corona created by the edges of the wire.

It is also an advantage of the present invention that is eliminates the process of putting lugs, rings or loops on the ends of corona wire and makes it easier to cut the wire to a predetermined length.

DETAILED DESCRIPTION OF THE INVENTION

Figure 1:
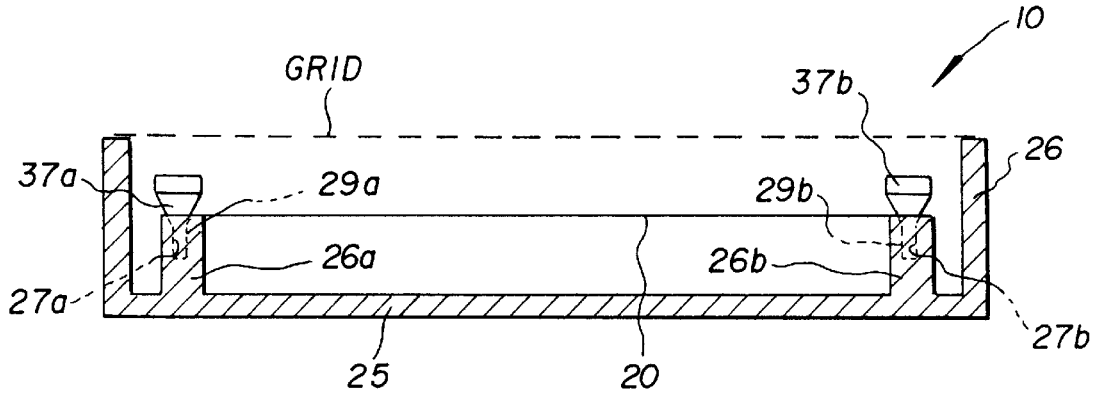
FIG. 1 is a schematic cross section of a gridded corona charger in accordance with a preferred embodiment of the invention.
Figure 2:
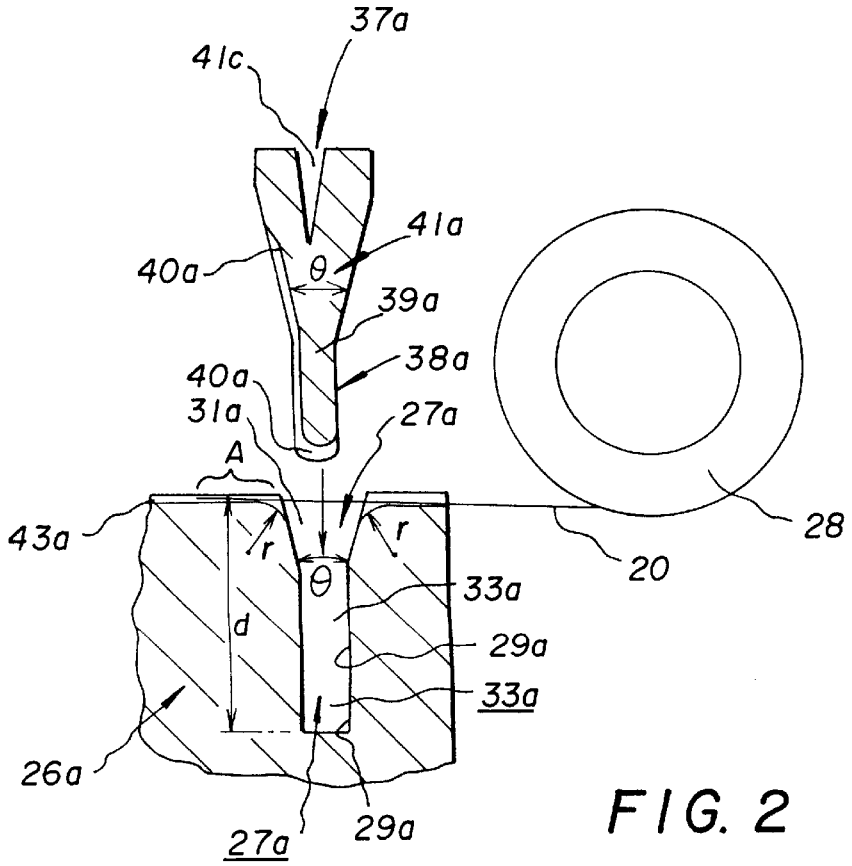
FIG. 2 illustrates a first cavity, a corona wire stretched over the first cavity and a pin (in position 1) for closing this cavity.

FIG. 1 illustrates a corona charger 10 of the first embodiment of the present invention. A corona wire 20 having two ends 20*a*, 20*b* (not shown) is strung across the housing 25 of the corona charger 10 and the ends 20*a*, 20*b* are affixed to the housing 25 with pins 37*a*, 37*b* (described in detail later in the specification). More specifically, the housing 25 includes a frame 26 with two terminals 26*a*, 26*b*. Two cavities 27*a*, 27*b* defined by the respective inner walls 29*a*, 29*b* are formed in these terminals. FIG. 2 illustrates the cavity 27*a*. (Cavity 27*b* has a shape that is identical to the shape of the cavity 27*a*.) The walls 29*a* form a first, conical portion 31*a* and a second, cylindrical portion 33*a* of the first cavity 27*a*. Similarly, the walls 29*b* form a first, conical section and a second cylindrical section of the second cavity. The cavity 27*a* is located in the first, i.e., start terminal 26*a*. The cavity 27*b* is located in the second terminal 26*b*. According to a preferred embodiment of the invention, the following method is used to attach corona wire 20 to the corona charger housing 25.

Figure 3:
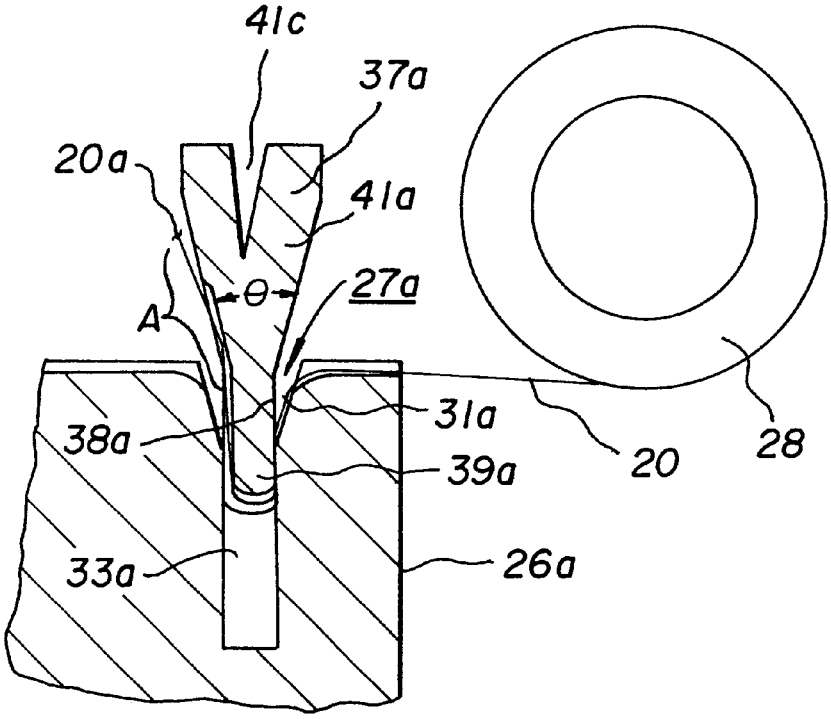
FIG. 3 is similar to FIG. 2 but shows the pin partially inserted into the cavity. The pin is shown in position 2.
Figure 4:
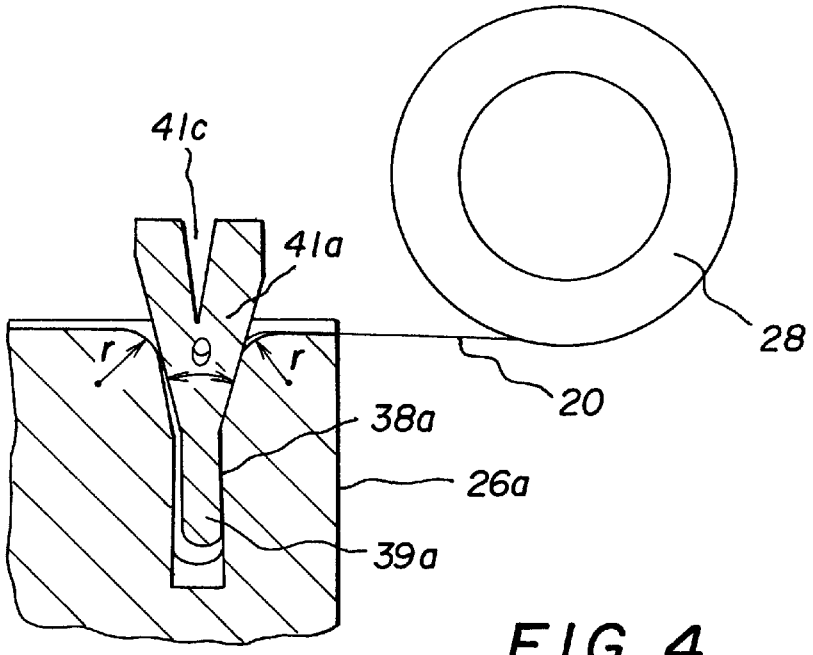
FIG. 4 is similar to FIG. 2, but shows an end of wire being pulled into the cavity by the motion of the pin of FIG. 2. The pin is shown in position 3.
Figure 5:
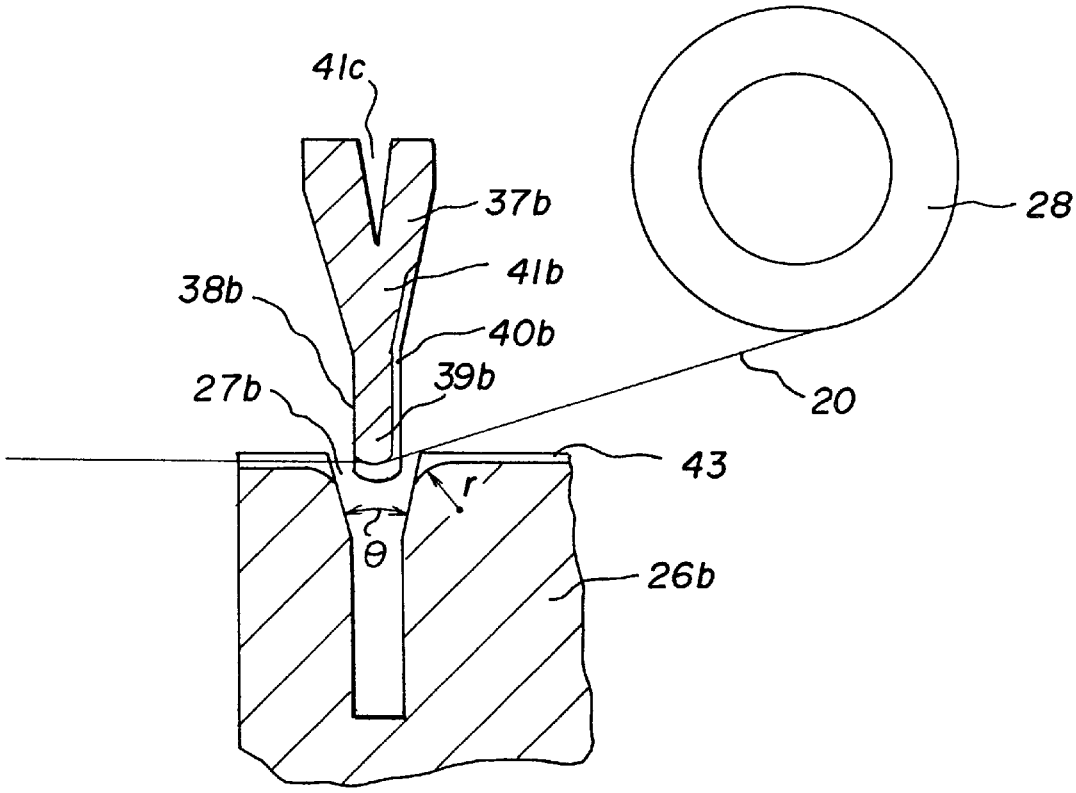
FIG. 5 illustrates a second cavity, a corona wire stretched over the second cavity and a second pin, in position 1, for closing the second cavity.

First, the wire 20 is stretched across the cavity 27*a* so that one end of the wire is in close proximity of the cavity 27*a*. This is shown in FIG. 2. It is preferred that the section A of the wire 20, close to the end 20*a* of the wire 20 and extending beyond the cavity 27*a* across at least a portion of the terminal 26*a*, be equal to or shorter than the cavity depth d. (See FIG. 2.) Then the pin 37*a* is inserted into the cavity 27*a*, fixing the loose wire end 20*a* inside the first cavity 27*a*. (See FIGS. 3 and 4). After one end 20*a* of the wire 20 is fixed in the housing via the pin 27*a*, a spool 28 containing the corona wire 20 is pulled towards the end terminal 26*b*, the wire 20 is strung across the housing 25 and the wire 20 is placed over the second cavity 27*b*. (FIG. 5.) The second pin

Figure 6:
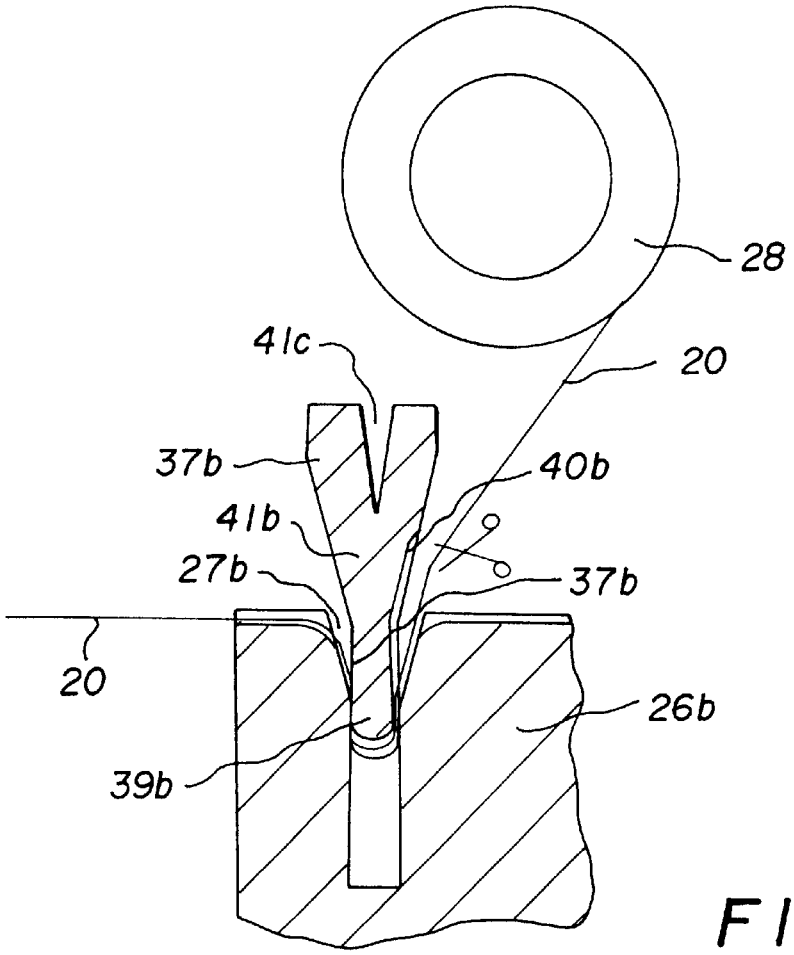
FIG. 6 is similar to FIG. 5 but shows the second pin in position 2, i.e., partially inserted into the second cavity and a corona wire that is being cut.
Figure 7:
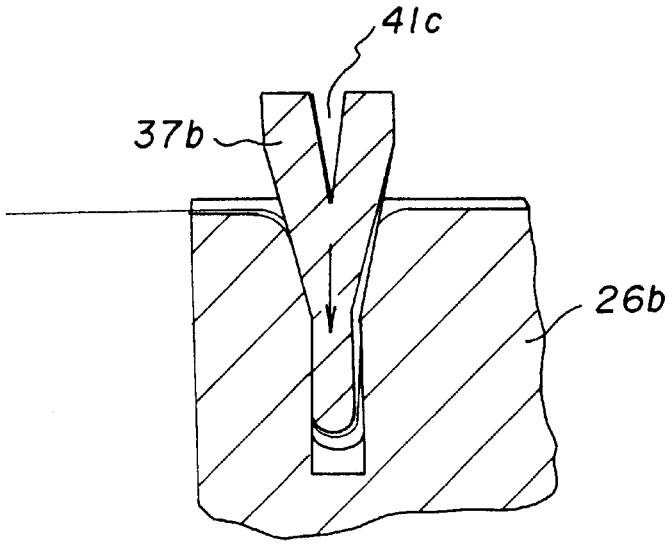
FIG. 7 shows an end of wire being pulled into the cavity by the motion of the second pin. The second pin is shown in position 3.

37*b* is partially inserted into the second cavity 27*b* (the pin 37*b* is in position 2) and the wire 20 is cut, separating the wire 20 from the spool of wire. (FIG. 6.) Then, the second pin 37*b* is pressed deeper into the cavity 27*b* (i.e., the second pin 27*b* assumes position #3), trapping the loose end 20*b* of the wire 20 inside the second cavity 27*b*. (FIG. 7.) Thus, the pins 37*a*, 37*b* securely hold the loose ends 20*a*, 20*b* of the wire 20 inside the cavities 27*a*, 27*b*. More specifically, the first loose end 20*a* of the wire 20 and the section A of the wire proximate to it are held inside a slot 40*a* of the inserted pin 37*a*. This slot extends over the bottom portion of the pin 37*a* and vertically across one of its sides. The section of the wire adjacent to section A is held between the wall 29*a* of the cavity 27*a* and the surface 38*a* of the pin 37*a*. (The slots 40*a*, 40*b* of the pins 37*a*, 37*b* are described in detail later in the specification.) Similarly, the second loose end of the wire 20 and a section of the wire proximate to this end is held inside a slot 40*b* of the inserted pin 37*b*. The section of the wire adjacent to this section is held between the wall 29*b* of the cavity 27*b* and the surface 38*b* of the pin 37*b*. The pins 37*a* and 37*b* are preferably made of electrically non-conductive material (for example, plastic) and, therefore, do not create unwanted corona.

Figure 8:
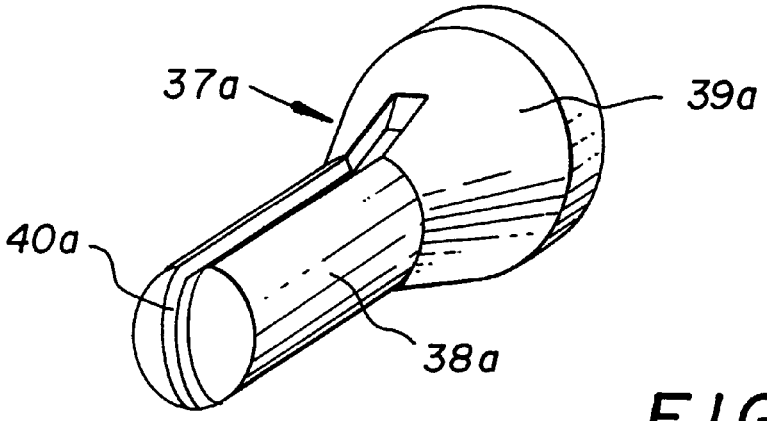
FIG. 8 is a perspective view of the pin of FIG. 2.

FIGS. 2 and 8 illustrate the shape of the pin 37*a*. These figures show only one pin 37*a* because the pins 37*a* and 37*b* are identical to one another. The pins 37*a* and 37*b* are shaped to allow the wire 20 to be cut approximately to the edge of the cavity, so that the section A of the wire 20 is of proper length. (The shape of the pins 37*a*, 37*b* is discussed in detail later in the specification) The shape of the cavity 27*a* and the shape of the pin 37*a* ensure that the cut end 20*a* (of the wire 20) that is buried between the inner wall 29*a* of a cavity and a pin 37*a* eliminates the end 20*a* as a source of unwanted corona. The total length of the corona wire 20 is determined by the housing geometry such as, for example, the separation between the terminals 26*a*, 26*b*, the number of strings formed by a corona wire 20, and the depth of the cavities. The shape of the pins 37*a*, 37*b* is complementary to the shape of the cavities. That is, the pins 37*a*, 37*b* have a cylindrical portion 39*a* and a conical portion 41*a*. In addition, the pin 37*a* has a slot 40*a* extending at least partially through the bottom and one side of the cylindrical portion 38*a* and one side of at least a section of the conical portion 39*a*. Similarly, the pin 37*b* has a slot 40*b* extending at least partially through the cylindrical portion 39*b* and at least a section of the conical portion 41*b*. The pins 37*a*, 37*b* also have a pointed conical hole 41*c*.

The pins 37*a*, 37*b* are preferably made of a softer material than the material of the housing and the pins 37*a*, 37*b* are replaced each time the wire 20 is replaced. The softer material reduces damage and wear on the housing, for example, when the pins are removed. The angle θ between the two opposing inclining surfaces of the pins 37*a*, 37*b* and the identical angle θ between the opposing walls 29*a*, 29*b* forming the conical sections of the cavities 27*a*, 27*b* is small (about 7 degrees or less). This small angle is needed so that (i) the cavities 27*a*, 27*b* are self-locking (i.e., the pins are held inside the cavities by friction and have to be removed from the cavities by force), and (ii) enough pressure is applied on the wire to keep the tensioned wire securely in place. (The smaller the angle, the more pressure is created on the wire). It is preferred that the pins 37*a*, 37*b* be slotted on the bottom and on one side so that (i) the wire 20 is held within the slot at the bottom portion of the pin as the pin 37*a*, 37*b* is pressed into the cavity 37*a*, 37*b* and (ii) the loose end of the wire is 20 is pulled into the slot 40*a*, 40*b*. When the pins 37*a*, 37*b* are pressed into their respective cavities, the slots 40*a*, 40*b* of the pins 37*a*, 37*b* (see FIG. 3) catch the wire 20 and the movement of the pins into the cavities ensures that the loose ends of the wire 20 are guided in the slot 40*a* and 40*b*. When the cylindrical portion 39*a*, 39*b* of the pins 37*a*, 37*b* moves into the cylindrical portion 33*a*, 33*b* of the cavity 27*a*, 27*b*, the wire 20 is fixed, to the side of the housing facing a slotless side of the pin wall, by friction and pressure applied by the pin 37*a* or 37*b*. The tolerances are chosen that way that the force of 2 to 8 N (Newtons) is needed to push the pins 37*a*, 37*b* into the cavities 27*a*, 27*b*. With this configuration, the difference in friction and pressure on the wire 20 on one side of the pin 37*a*, 37*b* (the side with the slot 40*a*, 40*b*) relative to the other side (slotless side, the side adjacent to the spool) of the pin 37*a*, 37*b*, ensures that the loose end of the wire 20 is pulled into the cavity 27*a*, 27*b* and that the side of the wire 20 which is connected to the spool is not pulled into the cavity 27*a*, 27*b*.

It is noted however, that a slotless pin made of very pliable plastic may also be used. Such a pin will not require the slot, because the wire, while it is pulled into the cavity together with the pin, will create a small indentation in the surface of such pin and be trapped between the wall of the cavity and the surface of the pin. However, this configuration is not preferred because the side of the wire that is connected to the spool is also pulled into the cavity, possibly stretching and causing some stress to the wire 20.

Because the coefficient of friction is smaller between the pin 37*a*, 37*b* and the wire 20 than the coefficient of friction between the housing wall 29*a* and the wire 20, the wire 20 does not slide along the housing wall 29*a*. The end portion of the loose wire 20 is buried in the cavity 27*a*, 27*b* inside the slot 40*a*, 40*b* so that the generation of a corona by the ends 20*a*, 20*b* of the wire 20 is suppressed. It is preferable that the edge radius r of the cavity 27*a*, 27*b* be large enough (i.e., 1 mm$\leqq$ r$\leqq$8 mm) to avoid high bending tensions in the wire 20. (FIG. 2.)

Figure 9:
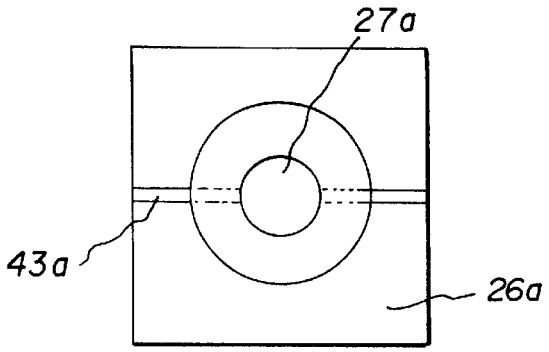
FIG. 9 is a top view of a start terminal, including a first cavity and slots for guiding the corona wire.

Both the start terminal 26*a* and the end terminal 26*b* have small slots 43*a*, 43*b*. (See FIG. 9.) These slots have a cross section of about 0.5 mm by 0.5 mm to about 2 mm by 1 mm cross and extend in the direction the wire 20 is tensioned. These slots 43*a*, 43*b* position the wire 20 relative to the cavity 27*a*, 27*b*. The slots 40*a*, 40*b* in the pins and the slots 43*a*, 43*b* in the terminals 26*a*, 26*b* capture the wire 20 (which is under slight tension), and ensure that the housing, the wire and the pins are aligned properly (FIG. 6).

Figure 10A:
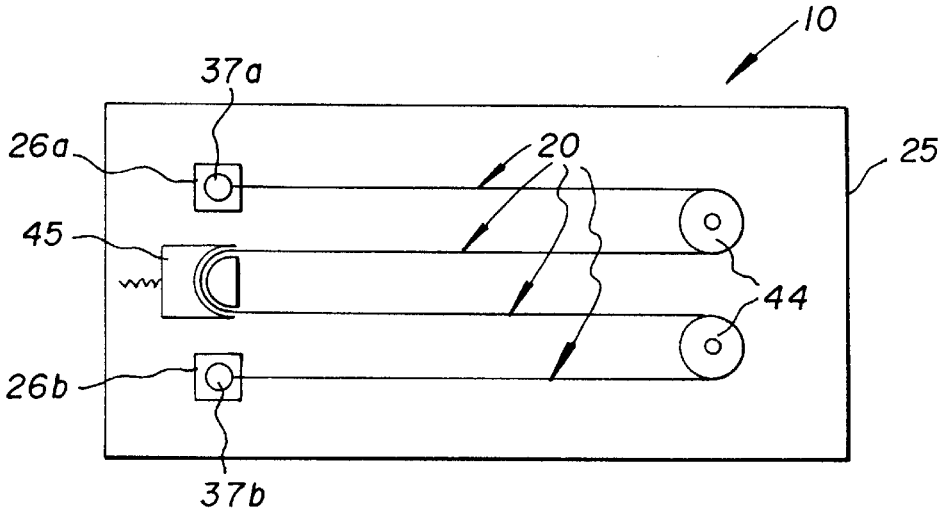
FIG. 10*a* is a schematic top view of a corona charger and a single corona wire that forms two strings of corona wire.
Figure 10B:
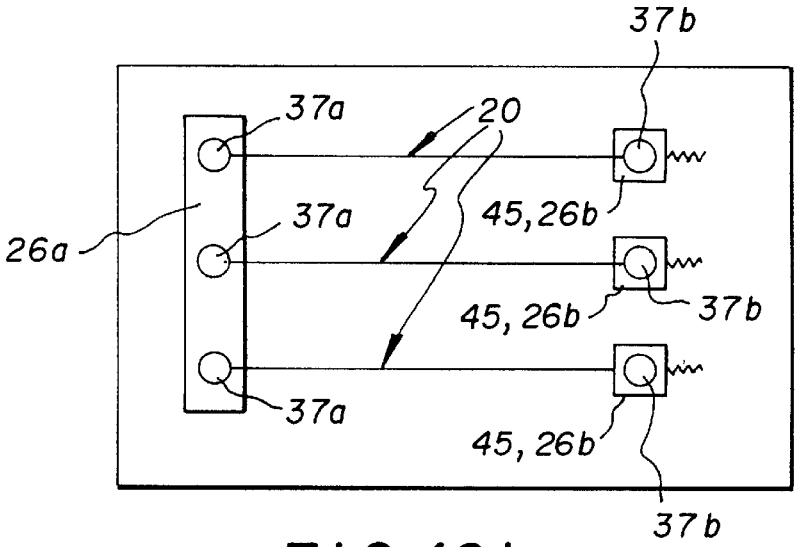
FIG. 10*b* is a top view of another corona charger. This corona charger utilizes separate strings of corona wire.

Two more examples of a corona charger 10 are illustrated in FIGS 10*a* and 10*b*. FIG. 10*a* is a schematic top view of the corona charger that utilizes a single corona wire that is looped around two rollers 44 to form several parallel strings of corona wire. The corona charger of FIG. 10*b* utilizes separate strings of corona wire. The housings 25 of these corona chargers 10 also support one or more tensioning mechanisms 45. (FIGS. 10*a*, 10*b*.) The tensioning mechanism 45, which sets the corona wire 20 under the final tension is mounted after the corona wire 20 is strung into the frame 26. In the corona charger 10 illustrated in FIG. 10*b* the tensioning mechanisms 45 also perform the function of the end terminals 26*b*. The tensioning mechanism 45 of the corona charger 10 is connected to a high voltage source (not shown). The voltage, provided by this source creates a requisite current flow to the corona wire 20.

To replace the wire 20, a corkscrew like tool is used to pull out the pin 37*a*, 37*b*. The tool is screwed into the conical hole 41*c* (FIG. 2) of the pin 37*a* or 37*b* and then the pin is pulled out like a cork out of the bottle. An alternative way of removing the pins is, for example, removing the pins with pliers. Other ways of removal are also possible.

It is an advantage of the present invention that the corona wire can easily be placed into the housing of a corona charger. The separation (cutting) of the corona wire 20 after the second pin 37*b* is placed in position 2 (FIG. 6) is easy. The wire 20 always has the right length and that there are no free pinpointed ends of the wire which could cause unwanted corona. The amount of conducting metal parts (danger of corona) is reduced to a minimum.

The invention has been described in detail with particular reference to certain preferred embodiments thereof, but it will be understood that variations and modifications can be effected within the spirit and scope of the invention.

PARTS LIST

10 corona charger
20 corona wire
20*a, b* ends of corona wire
25 charger housing
26 frame
26*a* start terminal
26*b* end terminal
28 wire spool
27*a, b* cavities
29*a* inner wall of cavity 27*a*
29*b* inner wall of cavity 27*b*
31*a, b* conical portion of the cavities
33*a, b* cylindrical portion of the cavities
37*a, b* pins
38*a* surface of the pin 37*a*
38*b* surface of the pin 37*b*
39*a* cylindrical portion of the pin 37*a*
39*b* cylindrical portion of the pin 37*b*
40*a* slot in pin 37*a*
40*b* slot in pin 37*b*
41*a* conical portion of the pin 37*a*
41*b* conical portion of the pin 37*b*
41*c* conical holes in the pins 37*a*, 37*b*
43*a, b* slot in the housing
45 tensioning mechanism

What is claimed is:

1. An apparatus comprising:

(i) a corona charger housing, said housing having at least one cavity;

(ii) a corona wire strung across said housing, said corona wire having at least one end located in said cavity;

(iii) a plug fixedly securing said wire end in said cavity; and wherein said plug and said cavity each have a mating angled surface that emanates from a cylindrical surface and wherein the angled surface deviates from the cylindrical surface by less than about 7 degrees.

2. An apparatus according to claim 1 wherein said plug is an electrically non-conductive pin having a shape complementary to the shape of said cavity.

3. An apparatus according to claim 2, wherein said pin has a cylindrical section and a slot on one side of said cylindrical section.

4. An apparatus according to claim 3 wherein said slot is 0.5 to 1 mm deep and 0.5 to 2 mm wide.

5. An apparatus according to claim 2, wherein said housing has inner walls surrounding said cavity and said pin is softer than said inner walls.

6. An apparatus comprising:

(i) corona charger housing, said housing having at least two cavities;

(ii) a corona wire strung across said housing, said corona wire having two ends, each of said wire ends being located in one of said two cavities;

(iii) plugs securing said wire ends in said cavities; and wherein said plugs and said cavities each have a mating angled surface that emanates from a cylindrical surface and wherein the angled surface deviates from the cylindrical surface by less than about 7 degrees.

7. An apparatus according to claim 6, wherein said plugs are electrically non-conductive, each of said plugs is at least partially located inside one of said cavities, and said plugs fixedly secure respective said ends of said corona wire inside said cavities.

8. An apparatus according to claim 7, wherein each of said plugs is a pin with a conical section and a cylindrical section; and each of said cavities has a complementary conical section and a complementary cylindrical section.

9. An apparatus according to claim 8, wherein each of said pins has a slot on one side of said cylindrical section.

10. An apparatus according to claim 8 wherein said slot is 0.5 to 1 mm deep and 0.5 to 2 mm wide.

11. An apparatus according to claim 8 wherein two opposing sides of said conical section of each of said pins angled with respect to one another, forming an angle of less than seven degrees.

12. An apparatus according to claim 9, wherein said pin has a head having a conical hole.

13. An apparatus according to claim 7, wherein said plugs are pins with shapes complementary to shapes of said cavities, and a coefficient of friction between said pins and said corona wire is smaller than coefficient of friction between cavity walls and said corona wire.

14. An apparatus according to claim 7, wherein each of said cavities has a curved opening defined by a radius of curvature r, and 1 mm<r<8 mm.

15. An apparatus according to claim 7, wherein said housing has inner walls surrounding said cavities and said plugs are pins that are softer than said inner walls.

16. A method of securing a corona charge wire to corona housing, said method comprising the steps of:

(i) stringing a corona wire across a first cavity;

(ii) cutting said corona wire, thereby forming a first end of corona wire;

(iii) securing said first end of corona wire inside said first cavity with a pin, wherein said pin and said first cavity each have a mating angled surface that emanates from a cylindrical surface and wherein the angled surface deviates from the cylindrical surface by less than about 7 degrees.

17. A method of securing a corona charge wire to corona housing, said method comprising the steps of:

(i) stringing a corona wire across a first cavity;

(ii) partially inserting a pin into said first cavity;

(iii) cutting said corona wire, thereby forming a first end of corona wire;

(iv) securing said first end of said corona wire with said pin inside said first cavity; and wherein said pin and said first cavity each have a mating angled surface that emanates from a cylindrical surface and wherein the angled surface deviates from the cylindrical surface by less than about 7 degrees.

18. A method according to claim 17, further comprising the steps of:

(i) stringing said corona wire across said housing;

(ii) stringing said corona wire across a second cavity;

(iii) partially inserting a second pin into said second cavity;

(iv) cutting said corona wire, thereby forming a second end of corona wire;

(v) securing said second end of corona wire with said second pin inside said second cavity; and wherein said second pin and said second cavity each have a mating angled surface that emanates from a cylindrical surface and wherein the angled surface deviates from the cylindrical surface by less than about 7 degrees.

19. A method according to claim 17 further comprising a step of inserting said pin deeper into said first cavity when trapping said first end of said corona wire inside said first cavity.

20. A method according to claim 19, further comprising the steps of:

(i) stringing the corona wire across said housing;

(ii) stringing said corona wire across a second cavity;

(iii) partially inserting a second pin into said second cavity;

(iv) cutting said corona wire, thereby forming a second end of corona wire;

(v) inserting said second pin deeper into said second cavity; and (vi) securing said second end of corona wire inside said second cavity.

* * * * *